US007980802B2

(12) United States Patent
Orgeron

(10) Patent No.: US 7,980,802 B2
(45) **Date of Patent: *Jul. 19, 2011**

(54) PIPE HANDLING APPARATUS WITH ARM STIFFENING

(75) Inventor: Keith J. Orgeron, Houston, TX (US)

(73) Assignee: T&T Engineering Services, Tomball, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/259,245

(22) Filed: Oct. 27, 2008

(65) Prior Publication Data

US 2009/0232624 A1 Sep. 17, 2009

Related U.S. Application Data

(63) Continuation-in-part of application No. 12/013,979, filed on Jan. 14, 2008, now Pat. No. 7,726,929, which is a continuation-in-part of application No. 11/923,451, filed on Oct. 24, 2007.

(51) Int. Cl.
*E21B 19/00* (2006.01)
*E04H 12/20* (2006.01)

(52) U.S. Cl. ..... 414/22.55; 414/22.52; 414/783; 414/742; 52/148; 52/167.6

(58) Field of Classification Search ..... 166/77.52, 166/77.53; 175/85; 294/81.61; 414/22.55, 414/22.62, 23, 546, 680, 729, 738, 740, 742, 414/746.8, 783; 52/119, 120, 148–149; 74/103, 74/110; 901/15, 21–22

See application file for complete search history.

(56) References Cited

U.S. PATENT DOCUMENTS

| | | | |
|---|---|---|---|
| 62,404 | A | 2/1867 | Gile et al. |
| 184,168 | A | 11/1876 | Nickle |
| 514,715 | A | 2/1894 | Jenkins |
| 1,249,194 | A | 12/1917 | Race |
| 1,264,867 | A | 4/1918 | Schuh |
| 1,312,009 | A | 8/1919 | Thrift |
| 1,318,789 | A | 10/1919 | Moschel |

(Continued)

FOREIGN PATENT DOCUMENTS

EP 0 024 433 A1 3/1981

(Continued)

OTHER PUBLICATIONS

U.S. Appl. No. 11/923,451, filed Oct. 24, 2007, Keith J. Orgeron.

(Continued)

*Primary Examiner* — Gregory W Adams
(74) *Attorney, Agent, or Firm* — John G. Fischer; Scheef & Stone LLP

(57) ABSTRACT

A pipe handling apparatus has a supporting structure, an arm pivotally interconnected to the supporting structure such that the supporting structure and the arm are movable between a first position and a second position within a single degree of freedom, and a stiffener cooperative with the arm when the arm and the supporting structure are in the second position. The stiffener applies a mechanical resistance to the arm in the second position. The second position is at an end of the travel of the supporting structure and the arm. The stiffener applies a variable resistance to the arm as the arm moves from the first position to the second position. This variable resistance is at its greatest when the arm is in the second position.

19 Claims, 7 Drawing Sheets

U.S. PATENT DOCUMENTS 2,124,154 A 7/1937 Sovincz
2,327,461 A * 8/1943 Rowe ..... 254/327
2,382,767 A * 8/1945 Zeilman ..... 212/299
2,497,083 A 2/1950 Hildebrand
2,535,054 A 12/1950 Ernst et al.
2,592,168 A 8/1952 Morris et al.
2,715,014 A * 8/1955 Garnett et al. ..... 254/326
2,770,493 A * 11/1956 Fieber ..... 239/168
3,059,905 A 10/1962 Tompkins
3,177,944 A 4/1965 Knight
3,262,593 A 7/1966 Hainer
3,280,920 A 10/1966 Scott
3,331,585 A 7/1967 Dubberke
3,365,762 A 1/1968 Spiri
3,464,507 A 9/1969 Alexander
3,561,811 A 2/1971 Turner, Jr.
3,633,771 A 1/1972 Woolslayer et al.
3,702,640 A 11/1972 Cintract et al.
3,703,968 A 11/1972 Uhrich et al.
3,806,021 A 4/1974 Moroz et al.
3,823,916 A 7/1974 Shaw
3,848,850 A 11/1974 Bemis
3,860,122 A 1/1975 Cernosek
3,963,133 A 6/1976 Gilli
3,986,619 A 10/1976 Woolslayer et al.
3,991,887 A 11/1976 Trout
3,995,746 A 12/1976 Usagida
4,011,694 A * 3/1977 Langford ..... 52/1
4,030,698 A 6/1977 Hansen
4,044,952 A * 8/1977 Williams et al. ..... 239/165
4,158,283 A * 6/1979 Nation ..... 57/200
4,172,684 A 10/1979 Jenkins
4,276,918 A * 7/1981 Sigouin ..... 144/24.13
4,303,270 A 12/1981 Adair
4,336,840 A 6/1982 Bailey
4,403,666 A 9/1983 Willis
4,403,897 A 9/1983 Willis
4,407,629 A 10/1983 Willis
4,420,917 A * 12/1983 Parlanti ..... 52/123.1
4,440,536 A 4/1984 Scaggs
4,492,501 A 1/1985 Haney
4,529,094 A 7/1985 Wadsworth
4,595,066 A 6/1986 Nelmark et al.
4,650,237 A 3/1987 Lessway
4,708,581 A 11/1987 Adair
4,759,414 A 7/1988 Willis
4,765,401 A 8/1988 Boyadjieff
4,822,230 A 4/1989 Slettedal
4,834,604 A 5/1989 Brittain et al.
4,869,137 A 9/1989 Slator
5,060,762 A 10/1991 White
5,135,119 A 8/1992 Larkin
5,186,264 A 2/1993 Du Chaffaut
5,458,454 A 10/1995 Sorokan
5,597,987 A 1/1997 Gilliland et al.
5,609,226 A 3/1997 Penisson
5,649,745 A 7/1997 Anderson
5,660,087 A 8/1997 Rae
5,671,932 A * 9/1997 Chapman ..... 280/47.11
5,806,589 A 9/1998 Lang
5,848,647 A 12/1998 Webre et al.
5,964,550 A 10/1999 Blandford et al.
5,992,801 A 11/1999 Torres
5,993,140 A 11/1999 Crippa
6,003,598 A 12/1999 Andreychuk
6,158,516 A 12/2000 Smith et al.
6,220,807 B1 4/2001 Sorokan
6,234,253 B1 5/2001 Dallas
6,253,845 B1 7/2001 Belik
6,264,128 B1 7/2001 Shampine et al.
6,264,395 B1 7/2001 Allamon et al.
6,279,662 B1 8/2001 Sonnier
6,343,892 B1 2/2002 Kristiansen
6,398,186 B1 6/2002 Lemoine
6,431,286 B1 8/2002 Andreychuk
6,471,439 B2 10/2002 Allamon et al.
6,502,641 B1 1/2003 Carriere et al.
6,543,551 B1 4/2003 Sparks et al.
6,543,555 B2 4/2003 Casagrande
6,557,641 B2 5/2003 Sipos et al.
6,609,573 B1 8/2003 Day
6,705,414 B2 3/2004 Simpson et al.
6,745,646 B1 6/2004 Pietras et al.
6,748,823 B2 6/2004 Pietras
6,779,614 B2 8/2004 Oser
6,814,149 B2 11/2004 Liess et al.
6,845,814 B2 1/2005 Mason et al.
7,028,585 B2 4/2006 Pietras et al.
7,055,594 B1 6/2006 Springett et al.
7,077,209 B2 7/2006 McCulloch et al.
7,090,035 B2 8/2006 Lesko
7,090,254 B1 8/2006 Pietras et al.
7,117,938 B2 10/2006 Hamilton et al.
7,121,166 B2 10/2006 Drzewiecki
7,172,038 B2 2/2007 Terry et al.
7,289,871 B2 10/2007 Williams
7,398,833 B2 7/2008 Ramey et al.
7,438,127 B2 10/2008 Lesko
7,726,929 B1 6/2010 Orgeron
2002/0070187 A1 * 6/2002 Willim ..... 212/299
2003/0221871 A1 12/2003 Hamilton et al.
2008/0253866 A1 * 10/2008 Lops et al. ..... 414/22.55
2010/0032213 A1 2/2010 Orgeron
2010/0034619 A1 2/2010 Orgeron
2010/0034620 A1 2/2010 Orgeron
2010/0187740 A1 7/2010 Orgeron

FOREIGN PATENT DOCUMENTS

WO 93-15303 A1 8/1993
WO WO 2006038790 A1 * 4/2006

OTHER PUBLICATIONS

U.S. Appl. No. 12/013,979, filed Jan. 14, 2008, Keith J. Orgeron.
U.S. Appl. No. 12/111,907, filed Apr. 29, 2008; non-published; titled "Pipe Gripping Apparatus" and having a common inventor with the present patent application; now abandoned.
U.S. Appl. No. 12/371,590, filed Feb. 14, 2009; non-published; titled "Tubular Gripping Apparatus With Locking Mechanism" and having a common inventor with the present application.
U.S. Appl. No. 12/371,591, filed Feb. 14, 2009; non-published; titled "Tubular Gripping Apparatus With Locking Mechanism" and having a common inventor with the present application.
U.S. Appl. No. 12/371,593, filed Feb. 14, 2009; non-published; titled "Pipe Handling Apparatus With Stab Frame Stiffening" and having a common inventor with the present patent application.
U.S. Appl. No. 12/403,218, filed Mar. 12, 2009; pending publication Sep. 6, 2010; titled "Derrickless Pipe Handling Apparatus and Method" and having a common inventor with the present patent application.
U.S. Appl. No. 12/418,302, filed Apr. 3, 2009; pending publication Oct. 7, 2010; titled "Raise-Assist and Smart Energy System for a Pipe Handling Apparatus" and having a common inventor with the present application.
U.S. Appl. No. 12/469,598, filed May 20, 2009; pending publication Nov. 25, 2010; titled "Alignment Apparatus and Method for a Boom of a Pipe Handling System" and having a common inventor with the present application.
U.S. Appl. No. 12/632,261, filed Dec. 7, 2009; non-published; titled "Stabbing Apparatus and Method" and having a common inventor with the present application.
U.S. Appl. No. 12/633,891, filed Dec. 9, 2009; non-published; titled "Stabbing Apparatus for Centering Tubulars and Casings for Connection at a Wellhead" and having a common inventor with the present application.
U.S. Appl. No. 12/633,913, filed Dec. 9, 2009; non-published; titled "Apparatus for Pipe Tong and Spinner Deployment" and having a common inventor with the present application.
U.S. Appl. No. 12/789,332, filed May 27, 2010; pending publication; titled "Pipe Handling Boom Pretensioning Apparatus" and having a common inventor with the present patent application.
U.S. Appl. No. 12/850,572, filed Aug. 4, 2010; non-published; titled "Pipe Stand" and having a common inventor with the present patent application.

* cited by examiner

PIPE HANDLING APPARATUS WITH ARM STIFFENING

CROSS-REFERENCE TO RELATED U.S. APPLICATIONS

The present application is a continuation-in-part of U.S. application Ser. No. 12/013,979, filed on Jan. 14, 2008, and entitled "Pipe Handling and Casing Stabbing Apparatus and Method", presently pending. U.S. application Ser. No. 12/013,979, is a continuation-in-part of U.S. application Ser. No. 11/923,451, filed on Oct. 24, 2007 and entitled "Pipe Handling Apparatus and Method", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a tubular, or pipe, handling apparatus and casing stabbing apparatus. More particularly, the present invention relates to a pipe handling apparatus for moving a pipe from a horizontal orientation to a vertical orientation. Additionally, the present invention relates to pipe handling apparatus for installing pipes and casing upon a drilling rig. The present invention also relates to pipe handling apparatus that moves the pipe with a single degree of freedom. The present invention further relates to stiffening systems for preventing springback when loads are released.

2. Description of Related Art Including Information Disclosed Under 37 CFR 1.97 and 37 CFR 1.98.

Drill rigs have utilized several methods for transferring tubular members from a pipe rack adjacent to the drill floor to a mousehole in the drill floor or the well bore for connection to a previously transferred tubular or tubular string. The term "tubular" or "pipe" as used herein includes all forms of drill pipe, drill collars, casing, liner, bottom hole assemblies (BHA), and other types of tubulars known in the art.

Conventionally, drill rigs have utilized a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

One method of transferring pipe from the rack to the well platform comprises tying one end of a line on the rig around a selected pipe on the pipe rack. The pipe is thereafter lifted up onto the platform and the lower end thereof is placed into the mousehole. The mousehole is simply an upright, elongate cylindrical container adjacent to the rotary table which supports the pipe temporally. When it is necessary to add the pipe to the drill string, slips are secured about the drill string on the rotary table thereby supporting the same in the well bore. The pipe is disconnected from the traveling equipment, and the elevators, or the kelly, are connected to the pipe in the mousehole. Next, the traveling block is raised by positioning the pipe over the drill string. Tongs are used to secure the pipe to the upper end of the drill string. The drill pipe elevators suspend the drill pipe from a collar, which is formed around one end of the pipe and does not clamp the pipe, thereby permitting rotational pipe movement in order to threadably engage the same to the drill string.

A prior art technique for moving joints of casing from racks adjacent to the drilling rig comprises tying a line from the rig onto one end of a selected casing joint on the rack. The line is raised by lifting the casing joint up a ramp leading to the rig platform. As the rope lifts the casing from the rack, the lower end of the casing swings across the platform in a dangerous manner. The danger increases when a floating system is used in connection with drilling. Because the rope is tied around the casing at one end thereof, the casing does not hang vertically, but rather tilts somewhat. A man working on a platform elevated above the rig floor must hold the top of the casing and straighten it out while the casing is threaded into the casing string which is suspended in the well bore by slips positioned on the rotary table.

It is desirable to be able to grip casing or pipe positioned on a rack adjacent a drilling well, move the same into vertical orientation over the well bore, and thereafter lower the same onto the string suspended in the well bore.

In the past, various devices have been created which mechanically move a pipe from a horizontal orientation to a vertical orientation such that the vertically oriented pipe can be installed into the well bore. Typically, these devices have utilized several interconnected arms that are associated with a supporting structure. In order to move the pipe, a succession of individual movements of the levers, arms, and other components of the supporting structure must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programing is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary to as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

In the past, pipe handling apparatus have not been used for the installation of casing. The problem associated with casing is that the threads of the casing are formed on an inner wall and on an outer wall at the ends of each of the casing sections. Whenever these threads are formed, the relatively thin wall thickness of the casing is further minimized. Additionally, great precision is required so as to properly thread the threads of one casing section within the threads of an adjacent casing section. The amount of accuracy required for the delivery of the casing by a pipe handling apparatus, in the past, has not been sufficient so as to achieve the desired degree of accuracy for the installation of the casing sections in their threaded connection. The improper installation of one casing section upon another casing section can potentially damage the threads associated with such casing sections. Additionally, in the past, the pipe handling apparatus could potentially damage the thin-walled casing sections during the delivery. As such, a need has developed to adapt a pipe handling apparatus so as to achieve the desired amount of accuracy for the installation of casing sections.

In the past, various patents have issued relating to such pipe handling devices. For example, U.S. Pat. No. 3,177,944, issued on Apr. 13, 1965 to R. N. Knight, describes a racking mechanism for earth boring equipment that provides for horizontal storage of pipe lengths on one side of and clear of the derrick. This is achieved by means of a transport arm which is pivoted toward the base of the derrick for swing movement in a vertical plane. The outer end of the arm works between a substantially vertical position in which it can accept a pipe length from, or deliver a pipe length to, a station in the derrick, and a substantially horizontal portion in which the arm can deliver a pipe length to, or accept a pipe length from, a station associated with storage means on one side of the derrick.

U.S. Pat. No. 3,464,507, issued on Sep. 2, 1969 to E. L. Alexander et al., teaches a portable rotary pipe handling system. This system includes a mast pivotally mounted and movable between a reclining transport position to a desired position at the site drilling operations which may be at any angle up to vertical. The mast has guides for a traveling mechanism that includes a block movable up and down the mast through operation of cables reeved from the traveling block over crown block pulleys into a draw work. A power drill drive is carried by the traveling block. An elevator for drill pipe is carried by arm swingably mounted relative to the power unit. Power tongs, slips, and slip bushings are supported adjacent the lower end of the mast and adapted to have a drill pipe extend therethrough from a drive bushing connected to a power drive whereby the drill pipe is extended in the direction of the hole to be drilled.

U.S. Pat. No. 3,633,771 issued on Jan. 11, 1972 to Woolslayer et al., discloses an apparatus for moving drill pipe into and out of an oil well derrick. A stand of pipe is gripped by a strongback which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevator suspended from the traveling block.

U.S. Pat. No. 3,860,122, issued on Jan. 14, 1975 to L. C. Cernosek, describes an apparatus for transferring a tubular member, such as a pipe, from a storage area to an oil well drilling platform. The positioning apparatus includes a pipe positioner mounted on a platform for moving the pipe to a release position whereby the pipe can be released to be lowered to a submerged position. A load means is operably attached or associated with the platform and positioning means in order to move the pipe in a stored position to a transfer position in which the pipe is transferred to the positioner. The positioner includes a tower having pivotally mounted thereon a pipe track with a plurality of pipe clamp assemblies which are adapted to receive a pipe length. The pipe track is pivotally movable by a hydraulic power means or gear means between a transfer position in which pipe is moved into the plurality of clamp assemblies and the release position in which the pipe is released for movement to a submerged position.

U.S. Pat. No. 3,986,619, issued on Oct. 19, 1976 to Woolslayer et al., shows a pipe handling apparatus for an oil well drilling derrick. In this apparatus the inner end of the boom is pivotally supported on a horizontal axis in front of a well. A clamping means is pivotally connected to the outer end of the boom on an axis parallel to the horizontal axis at one end. The clamping means allows the free end of the drill pipe to swing across the boom as the outer end of the boom is raised or lowered. A line is connected at one end with the traveling block that raises and lowers the elevators and at the other end to the boom so as to pass around sheaves.

U.S. Pat. No. 4,172,684, issued on Oct. 30, 1979 to C. Jenkins, shows a floor level pipe handling apparatus which is mounted on the floor of an oil well derrick suitable structure. This apparatus includes a support that is rockable on an axis perpendicular to the centerline of a well being drilled. One end of an arm is pivotally mounted on the support on an axis transverse to the centerline of the well. The opposite end of the arm carries a pair of shoes having laterally opening pipe-receiving seats facing away from the arm. The free end of the arm can be swung toward and away from the well centerline and the arm support can be rocked to swing the arm laterally.

U.S. Pat. No. 4,403,666, issued on Sep. 13, 1983 to C. A. Willis, shows self-centering tongs and a transfer arm for a drilling apparatus. The clamps of the transfer arm are resiliently mounted to the transfer arm so as to provide limited axial movement of the clamps and thereby of a clamped down hole tubular. A pair of automatic, self-centering, hydraulic tongs are provided for making up and breaking out threaded connections of tubulars.

U.S. Pat. No. 4,407,629, issued on Oct. 4, 1983 to C. A. Willis, teaches a lifting apparatus for downhole tubulars. This lifting apparatus includes two rotatably mounted clamps which are rotatable between a side loading-position so as to facilitate the loading and unloading in the horizontal position, and a central position, in which a clamped tubular is aligned with the drilling axis when the boom is in the vertical position. An automatic hydraulic sequencing circuit is provided to automatically rotate the clamps into the side-loading position whenever the boom is pivoted with a down-hole tubular positioned in the clamp. In this position, the clamped tubular is aligned with a safety plate mounted on the boom to prevent a clamped tubular from slipping from the clamps.

U.S. Pat. No. 4,492,501 provides a platform positioning system for a drilling operation which includes a support structure and a transfer arm pivotally connected to the support structure to rotate about a first axis. This platform positioning system includes a platform which is pivotally connected to the support structure to rotate about a second axis, and rod which is mounted between the transfer arm and the platform. The position of the arm and platform axes and the length of the rod are selected such that the transfer arm automatically and progressively raises the platform to the raised position by means of the rod as the transfer arm moves to the raised position. The transfer arm automatically and progressively lowers the platform to the lowered position by means of the rod as the transfer arm moves to the lowered position.

U.S. Pat. No. 4,595,066, issued on Jun. 17, 1986 to Nelmark et al., provides an apparatus for handling drill pipes and used in association with blast holes. This system allows a drill pipe to be more easily connected and disconnected to a drill string in a hole being drilled at an angle. A receptacle is formed at the lower end of the carrier that has hydraulically operated doors secured by a hydraulically operated lock. A gate near the upper end is pneumatically operated in response to the hydraulic operation of the receptacle lock.

U.S. Pat. No. 4,822,230, issued on Apr. 18, 1989 to P. Slettedal, teaches a pipe handling apparatus which is adapted for automated drilling operations. Drill pipes are manipulated between substantially horizontal and vertical positions. The apparatus is used with a top mounted drilling device which is rotatable about a substantially horizontal axis. The apparatus utilizes a strongback provided with clamps to hold and manipulate pipes. The strongback is rotatably connected to the same axis as the drilling device. The strongback moves up or down with the drilling device. A brace unit is attached to the strongback to be rotatable about a second axis.

U.S. Pat. No. 4,834,604, issued on May 30, 1989 to Brittain et al., provides a pipe moving apparatus and method for moving casing or pipe from a horizontal position adjacent a well to a vertical position over the well bore. The machine includes a boom movable between a lowered position and a raised position by a hydraulic ram. A strongback grips the pipe and holds the same until the pipe is vertically positioned. Thereafter, a hydraulic ram on the strongback is actuated thereby lowering the pipe or casing onto the string suspended in the well bore and the additional pipe or casing joint is threaded thereto.

U.S. Pat. No. 4,708,581 issued on Nov. 24, 1987 H. L. Adair, provides a method for positioning a transfer arm for the movement of drill pipe. A drilling mast and a transfer arm is mounted at a first axis adjacent the mast to move between a lowered position near ground level and an upper position aligned with the mast. A reaction point anchor is fixed with respect to the drilling mast and spaced from the first axis. A fixed length link is pivotably mounted to the transfer arm at a second axis, spaced from the first axis, and a first single stage cylinder is pivotably mounted at one end to the distal end of the link and at the other end to the transfer arm. A second single stage hydraulic cylinder is pivotably mounted at one end to the distal end of the link and at the other end to the reaction point.

U.S. Pat. No. 4,759,414, issued on Jul. 26, 1988 to C. A. Willis, provides a drilling machine which includes a drilling superstructure skid which defines two spaced-apart parallel skid runners and a platform. The platform supports a drawworks mounted on a drawworks skid and a pipe boom is mounted on a pipe boom skid sized to fit between the skid runners of the drilling substructure skid. The drilling substructure skid supports four legs which, in turn, support a drilling platform on which is mounted a lower mast section. The pipe boom skid mounts a pipe boom as well as a boom linkage, a motor, and a hydraulic pump adapted to power the pipe boom linkage. Mechanical position locks hold the upper skid in relative position over the lower skid.

U.S. Pat. No. 5,458,454, issued on Oct. 17, 1995 to R. S. Sorokan, describes a pipe handling method which is used to move tubulars used from a horizontal position on a pipe rack adjacent the well bore to a vertical position over the wall center. This method utilizes bicep and forearm assemblies and a gripper head for attachment to the tubular. The path of the tubular being moved is close to the conventional path of the tubular utilizing known cable transfer techniques so as to allow access to the drill floor through the V-door of the drill rig. U.S. Pat. No. 6,220,807 describes apparatus for carrying out the method of U.S. Pat. No. 5,458,454.

U.S. Pat. No. 6,609,573, issued on Aug. 26, 2003 to H. W. F. Day, teaches a pipe handling system for an offshore structure. The pipe handling system transfers the pipes from a horizontal pipe rack adjacent to the drill floor to a vertical orientation in a set-back area of the drill floor where the drill string is made up for lowering downhole. The cantilevered drill floor is utilized with the pipe handling system so as to save platform space.

U.S. Pat. No. 6,705,414, issued on Mar. 16, 2004 to Simpson et al., describes a tubular transfer system for moving pipe between a substantial horizontal position on the catwalk and a substantially vertical position at the rig floor entry. Bundles of individual tubulars are moved to a process area where a stand make-up/break-out machine makes up the tubular stands. The bucking machine aligns and stabs the connections and makes up the connection to the correct torque. The tubular stand is then transferred from the machine to a stand storage area. A trolley is moved into position over the pick-up area to retrieve the stands. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole.

U.S. Pat. No. 6,779,614, issued on Aug. 24, 2004 to M. S. Oser, shows another system and method for transferring pipe. A pipe shuttle is used for moving a pipe joint into a first position and then lifting upwardly toward an upper second position.

U.S. application Ser. No. 11/923,451, filed on Oct. 24, 2007 by the present inventor, shows a pipe handling apparatus and method. During testing of the apparatus upon which this application is based, it is shown that there was a certain degree of springback of the arm upon the release of the pipe onto the drilling rig. During the delivery of the pipe to the drilling rig, the grippers associated with the arm of this apparatus will be handling a great deal of weight (up to 10,000 pounds). This apparatus proved very effective in placing the pipe in a desired location on the drilling rig. However, upon the release of the weight associated with the pipe, the grippers and the arm will have a springback of up to ten inches. Under certain circumstances, this springback could serve to deflect the pipe and create unnecessary stresses on the apparatus. As such, a need developed so as to avoid the springback associated with the release of the pipe from the grippers and from the arm. Additionally, it was found that by reducing the amount of springback, the accuracy of the pipe handling apparatus associated with this application could achieve a superior amount of precision in the installation of the pipe. The avoidance of the springback and the minimization of the deflection caused by the release of the load allows the pipe handling apparatus to be utilized, also, in association with the stabbing of the fine threads of casing into an adjacent casing section supported on the drill rig.

U.S. patent application Ser. No. 12/013,979, filed on Jan. 14, 2008 by the present inventor, describes a pre-loading system for a pipe handling apparatus in which a boom is pivotally mounted at one end to a skid and which an arm is interconnected to an opposite end of the boom. The pre-loading system has a tensioning system with one end affixed to the arm and an opposite end fixedly mounted so as to apply tension to the arm when the arm has a load applied to an end of the arm opposite the boom. The tensioning system includes a first cable assembly having one end interconnected to the arm and an opposite end fixedly mounted, and a second cable assembly interconnected to the arm and having an opposite end fixed mounted. The first and second cable assemblies extend from opposite sides of the arm. This system have been found to effectively prevent spring back of the arm such that pipe encasing can be properly delivered to a location.

It is an object of the present invention to provide a pipe handling and casing stabbing apparatus and method which minimizes the amount of calibration required in order to move the pipe from a horizontal orientation to a vertical orientation.

It is another object of the present invention to provide a pipe handling and casing stabbing apparatus which operates with a single degree of freedom so as to move the pipe without adjustments between the components.

It is another object of the present invention to provide a pipe handling and casing stabbing apparatus which operates with multiple degrees of freedom so as to move the pipe.

It is another object of the present invention to provide a pipe handling and casing stabbing apparatus that can be transported on a skid or on a truck.

It is another object of the present invention to provide a pipe handling and casing stabbing apparatus and method which allows for the self-centering of the pipe.

It is another object of the present invention to provide a pipe handling and casing stabbing apparatus and method which can be utilized independent of the existing rig.

It is still a further object of the present invention to provide a pipe handling and casing stabbing apparatus and method which avoids the use of multiple hydraulic cylinders and actuators.

It is still another object of the present invention to provide a pipe handling and casing stabbing apparatus and method which minimizes the amount of instrumentation and controls utilized for carrying out the pipe handling activities.

It is still another object of the present invention to provide a pipe handling and casing stabbing apparatus and method which allows for the pipe to be loaded beneath the supporting structure.

It is still a further object of the present invention to provide a pipe handling and casing stabbing apparatus and method which is of minimal cost and easy to use.

It is still a further object of the present invention to provide a pipe handling and casing stabbing apparatus and method which allows relatively unskilled workers to carry out the pipe handling activities.

It is a further object of the present invention to provide a pipe handling and casing stabbing apparatus and method which avoids springback of the arm upon release of the load.

It is still an additional object of the present invention to provide a pipe handling and casing stabbing apparatus and method which achieves greater precision in the delivery and installation of pipes and/or casing.

It is still another object of the present invention to provide a pipe handling and casing stabbing apparatus and method which allows casing to be installed in a proper manner such that the threads of the casing engage the threads proper of an adjacent casing.

It is still another object of the present invention to provide a pipe handling and casing stabbing apparatus and method which increases the structural stiffness of the apparatus.

These and other objects and advantages of the present invention will become apparent from a reading of the attached specification and appended claims.

BRIEF SUMMARY OF THE INVENTION

The present invention is a pipe handling apparatus for moving a pipe to a drill floor that comprises a supporting structure, an arm extending from the supporting structure such that the arm is movable between a first position away from the drill floor and a second position over the drill floor, and a stiffening member cooperative with the arm when the arm and the supporting structure are in the second position. The stiffening member applies a mechanical resistance to the arm in the second position.

In the present invention, the second position is an end of travel of the supporting structure and the arm. The stiffening member is cooperative with an end of the arm opposite the supporting structure. The stiffening member applies a variable resistance to the arm as the arm moves from the first position to the second position. The variable resistance is greatest when the arm is in the second position.

A gripper is affixed to an end of the arm opposite the supporting structure. The gripper receives a pipe therein. The gripper supports the pipe in a vertical orientation when the supporting structure and the arm are in the second position. The gripper also is for grasping a horizontally oriented pipe when the arm and the supporting structure are in the first position. The supporting structure has an opening interior area. The gripper is connected to the arm such that the pipe moves through the open interior area as the supporting structure and the arm move from the first position to the second position.

In the preferred embodiment of the present invention, the stiffening member comprises a first cable assembly having one end connected to the arm and an opposite end fixedly mounted such that the first cable assembly extends from one side of the arm and a second cable assembly having one end interconnected to the arm and an opposite end fixedly mounted such that the second cable assembly extends from an opposite side of the arm. Each of the first and second cable assemblies includes a link member pivotally mounted to the arm, a cable affixed to the link member at one end thereof, a spring pod affixed to an opposite end of the cable, and a member having one end connected to the spring pod and an opposite end fixedly mounted. The spring pod includes a connector element affixed to the opposite end of the cable and to the one end of the member, and a resilient member or spring interconnected to the connector member. The spring urges the connector element in a direction away from alignment of the member with the cable.

DETAILED DESCRIPTION OF THE INVENTION

Figure 1:
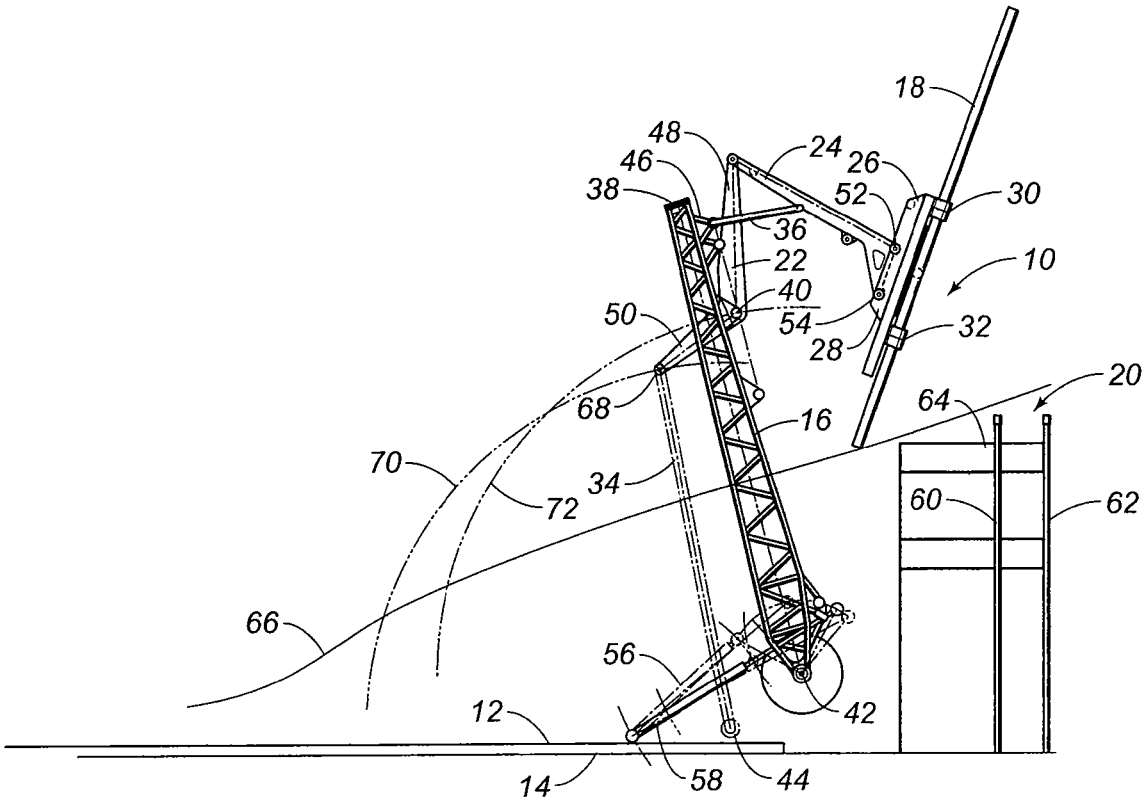
FIG. 1 is a side elevation view showing the pipe handling apparatus in accordance with the teachings of the preferred embodiment of the present invention.

Referring to FIG. 1, there is shown the pipe handling apparatus 10 for moving a pipe 18 to a drill floor 64 in accordance with the preferred embodiment of the present invention. The pipe handling apparatus 10 is mounted on a skid 12 that is supported upon the bed 14 of a vehicle, such as a truck. The pipe handling apparatus 10 in particular includes a supporting structure 16. The supporting structure 16 can be a boom that is pivotally mounted to an underlying structure, such as the skid 12. The supporting structure 16 is movable between a first position and a second position. In FIG. 1, an intermediate position of the pipe handling apparatus 10 is particularly shown. In this position, the pipe 18 is illustrated in its position prior to installation on the drill rig 20. A lever assembly 22 is pivotally connected to the supporting structure 16. An arm 24 is pivotally connected to an end of the lever assembly 22 opposite the supporting structure 16. The arm 24 can be made to be extendable in length. The arm 24 can also be made so as to have a fixed length. A gripper assembly 26 is fixedly connected to an opposite end of the arm 24 opposite the lever assembly 22. The gripper assembly 26 includes a body 28 and grippers 30 and 32. A link 34 has one end pivotally connected to the skid 12 and an opposite end pivotally connected to the end of the lever assembly 22 opposite the arm 24. A brace 36 is pivotally connected to the supporting structure 16 and also pivotally connected to the arm 24 between the lever assembly 22 and the body 28 of gripper assemblies 26.

In the present invention, the supporting structure 16 is a structural framework of struts, cross members and beams. In particular, in the present invention, the supporting structure 16 is configured so as to have an open interior such that the pipe 18 will be able to be lifted in a manner so as to pass through the interior of the supporting structure 16. As such, the end 38 of the supporting structure 16 should be strongly reinforced so as to provide the necessary structural integrity to the supporting structure 16. A lug 40 extends outwardly from one side of the supporting structure 16. This lug 40 is suitable for pivotable connection to the lever assembly 22. The supporting structure 16 is pivotally connected at the opposite end 42 to a location on the skid 12. The pivotable connection at end 42 of the supporting structure 16 is located in offset relationship and above the pivotable connection 44 of the link 34 with the skid 12. A small frame member 46 extends outwardly from the side of the supporting structure 16 opposite the link 34. This frame assembly 46 has a pivotable connection with the brace 36.

The lever assembly 22 includes a first portion 48 and a second portion 50. The first portion 48 extends at an obtuse angle with respect to the second portion 50. The link 34 is pivotally connected to the end of the second portion 50 opposite the first portion 48. The arm 24 is pivotally connected to the end of the first portion 48 opposite the second portion 50. The lug 40 of the supporting structure 16 is pivotally connected in an area generally between the first portion 48 and the second portion 50. This unique arrangement of the lever assembly 22 facilitates the ability of the present invention to carry out the movement of the pipe 18 between the horizontal orientation and the vertical orientation.

The arm 24 has an end pivotally connected to the end of the first portion 48 of the lever assembly 22. The opposite end of the arm 24 is connected to the gripper assembly 26. In particular, a pair of pin connections engages a surface of the body 28 of the gripper assembly 26 so as to fixedly position the gripper assembly 26 with respect to the end of the arm 24. The pin connections 52 and 54 can be in the nature of bolts, or other fasteners, so as to strongly connect the body 28 of the gripper assembly 26 with the arm 24. The bolts associated with pin connections 52 and 54 can be removed such that other gripper assemblies 26 can be affixed to the end of the arm 24. As such, the pipe handling apparatus 10 of the present invention can be adaptable to various sizes of pipe 18 and various heights of drilling rigs 20.

The gripper assembly 26 includes the body 28 with the grippers 30 and 32 translatable along the length of the body 28. This vertical translation of the grippers 30 and 32 allows the pipe 18 to be properly moved upwardly and downwardly once the vertical orientation of the pipe 18 is achieved. The grippers 30 and 32 are in the nature of conventional grippers which can open and close so as to engage the outer diameter of the pipe 18, as desired.

The link 34 is an elongate member that extends from the pivotable connection 44 to the pivotable connection 68 of the second portion 50 of the lever assembly 22. The link 34 is non-extensible and extends generally adjacent to the opposite side from the supporting structure 16 from that of the arm 24. The link 34 will generally move relative to the movement of the supporting structure 16. The brace 36 is pivotally connected to the small framework 46 associated with supporting structure 16 and also pivotally connected at a location along the arm 26 between the ends thereof. Brace 36 provides structural support to the arm 24 and also facilitates the desired movement of the arm 24 during the movement of the pipe 18 between the horizontal orientation and the vertical orientation.

Actuators 56 and 58 are illustrated as having one end connected to the skid 12 and an opposite end connected to the supporting structure 16 in a location above the end 42. When the actuators 56 and 58 are activated, they will pivot the supporting structure 16 upwardly from the horizontal orientation ultimately to a position beyond vertical so as to cause the pipe 18 to achieve a vertical orientation. Within the concept of the present invention, a single hydraulic actuator can be utilized instead of the pair of hydraulic actuators 56 and 58, as illustrated in FIG. 1.

The drilling rig 20 is illustrated as having drill pipes 60 and 62 extending upwardly so as to have an end above the drill floor 64. When the pipe 18 is in its vertical orientation, the translatable movement of the grippers 30 and 32 can be utilized so as to cause the end of the pipe 18 to engage with the box of one of the drill pipes 60 and 62.

In FIG. 1, the general movement of the bottom end of the pipe 18 is illustrated by line 66. The movement of the pivot point 68 of the connection between the lever assembly 22 and the link 34 is illustrated by line 70. Curved line 72 illustrates the movement of the pivotable connection 40 between the supporting structure 16 and the lever assembly 22.

In the present invention, the coordinated movement of each of the non-extensible members of the apparatus 10 is achieved with proper sizing and angular relationships. In essence, the present invention provides a four-bar link between the various components. As a result, the movement of the drill pipe 18 between a horizontal orientation and a vertical orientation can be achieved purely through the mechanics associated with the various components. As can be seen, only a single hydraulic actuator may be necessary so as to achieve this desired movement. There does not need to be coordinated movement of hydraulic actuators. The hydraulic actuators are only used for the pivoting of the supporting structure. Since the skid 12 is located on the bed of a vehicle 14, the vehicle 14 can be maneuvered into place so as to properly align with the centerline of the drill pipe 60 and 62 of the drilling rig 20. Once the proper alignment is achieved by the vehicle 14, the apparatus 10 can be operated so as to effectively move the drill pipe to its desired position. The gripper assemblies of the present invention allow the drill pipe 18 to be moved upwardly and downwardly for the proper stabbing of the drill pipes 60 and 62. The present invention is adaptable to various links of pipe 18.

Various types of gripper assembly 26 can be installed on the end of the arm 24 so as to properly accommodate longer lengths of pipe 18. These variations are illustrated herein in connections FIGS. 6-9.

As such, instead of the complex control mechanisms that are required with prior art systems, the present invention achieves it results by simple maneuvering of the vehicle 14, along with operation of the hydraulic cylinders 56 and 58. All other linkages and movement of the pipe 18 are achieved purely because of the mechanical connections between the various components. As such, the present invention assures a precise, self-centering of the pipe 18 with respect to the desired connecting pipe.

Figure 2:
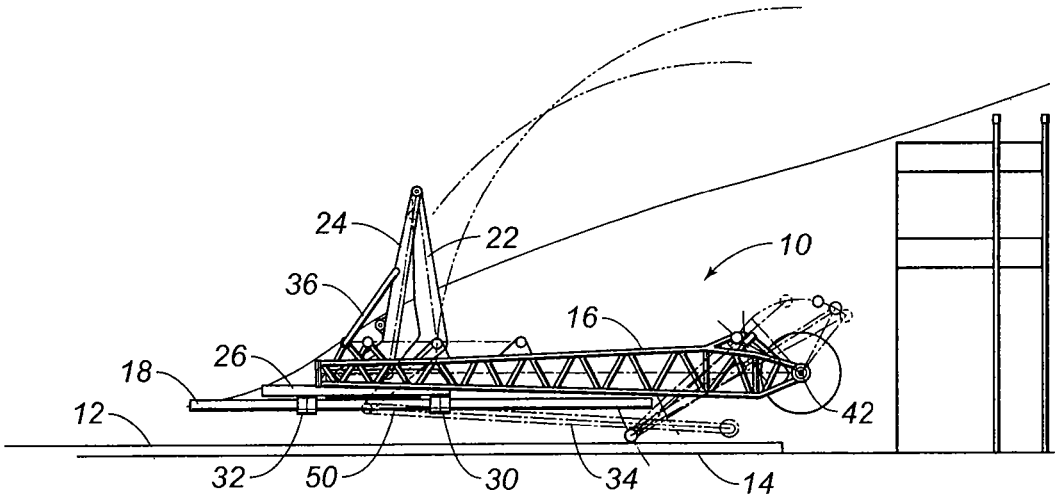
FIG. 2 is a side elevational view showing the pipe handling apparatus of the present invention in a first position.

FIG. 2 illustrates the drill pipe 18 in a generally horizontal orientation. In the present invention, it is important to note that the drill pipe can be delivered to the apparatus 10 in a position below the supporting structure 16. In particular, the drill pipe can be loaded upon the skid 12 in a location generally adjacent to the grippers 30 and 32 associated with the gripper assembly 26. As such, the present invention facilitates the easy delivery of the drill pipe to the desired location. The grippers 30 and 32 will grip the outer diameter of the pipe 18 in this horizontal orientation.

In FIG. 2, it can be seen that the supporting structure 16 resides above the drill pipe 18 and in generally parallel relationship to the top surface of the skid 12. The lever assembly 22 is suitably pivoted so that the arm 24 extends through the interior of the framework of the supporting structure 16 and such that the gripper assembly 26 engages the pipe 18. The brace 36 resides in connection with the small framework of the supporting structure 16 and also is pivotally connected to the arm 24. The link 34 will reside below the supporting structure 16 generally adjacent to the upper surface of the skid 12 and is connected to the second portion 50 of the lever assembly 22 below the supporting structure 16.

Figure 3:
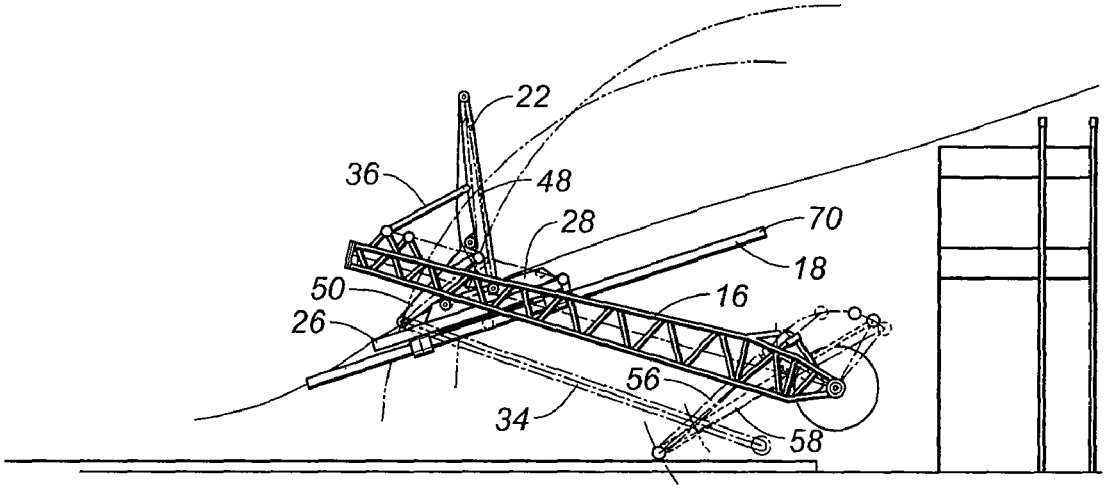
FIG. 3 is a side elevational view showing the pipe handling apparatus moving from the first position toward the second position.

FIG. 3 shows an intermediate position of the drill pipe 18 during the movement from the horizontal orientation to the vertical orientation. As can be seen, the gripper assembly 26 has engaged with the pipe 18. The lever assembly 22 is pivoting so that the end 70 of pipe 18 will pass through the interior of the framework of the supporting structure 16. Also, the arm associated with the gripper asssembly 26 serves to move the body 28 of the gripper assembly 26 through the interior of the framework of the supporting structure 16. The brace 36 is pulling on the first portion 48 of lever assembly 22 so as to cause this motion to occur. The link 34 is pulling on the end of the second portion 50 of the lever assembly 22 so as to draw the first portion 48 upwardly and to cause the movement of the body 28 of the gripper assembly 26. The hydraulic actuators 56 and 58 have been operated so as to urge the supporting structure 16 pivotally upwardly.

Figure 4:
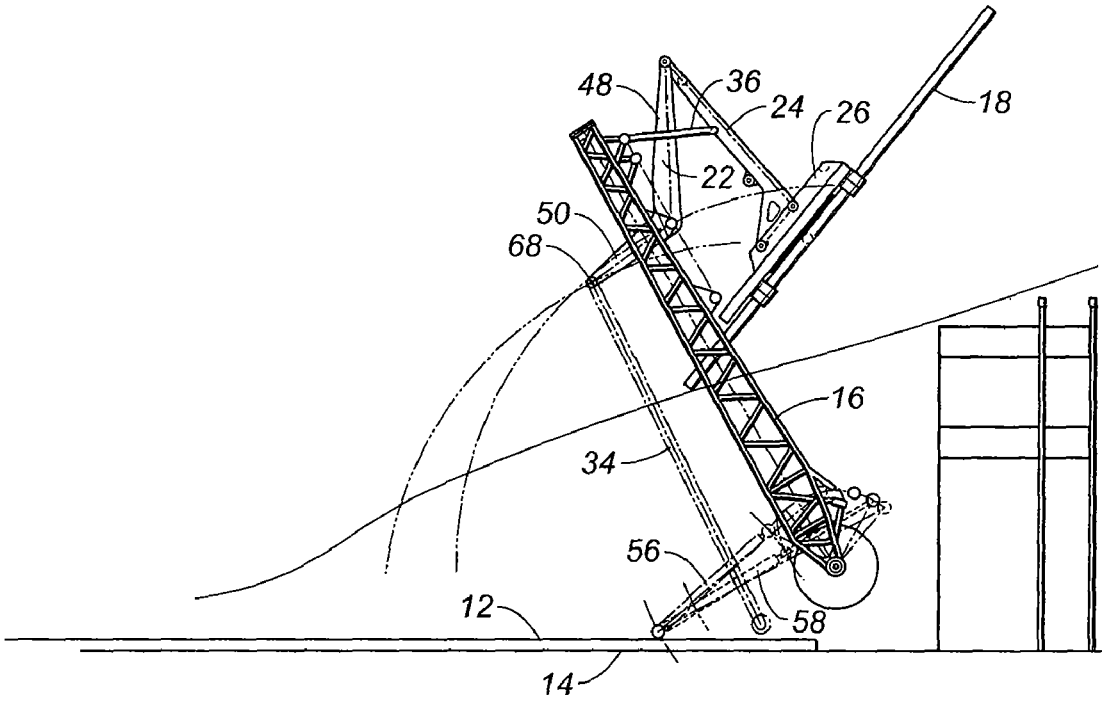
FIG. 4 is a side elevation view of the pipe handling apparatus showing the pipe handling apparatus as moving the pipe further to the second position.

FIG. 4 shows a further intermediate movement of the drill pipe 18. Once again, the hydraulic actuators 56 and 58 urge the supporting structure 16 angularly upwardly away from the top surface of the skid 12. This causes the link 34 to have a pulling force on the pivotal connection 68 of the second portion 50 of the lever assembly 22. This causes the first portion 48 of the lever assembly 22 to move upwardly thereby causing the arm 24, in combination with the brace 36, to lift the gripper assembly 26 further upwardly and draw the pipe 18 completely through the interior of the supporting structure 16. As can be seen, the relative size and relation of the various components of the present invention achieve the movement of the pipe 18 without the need for separate hydraulic actuators.

Figure 5:
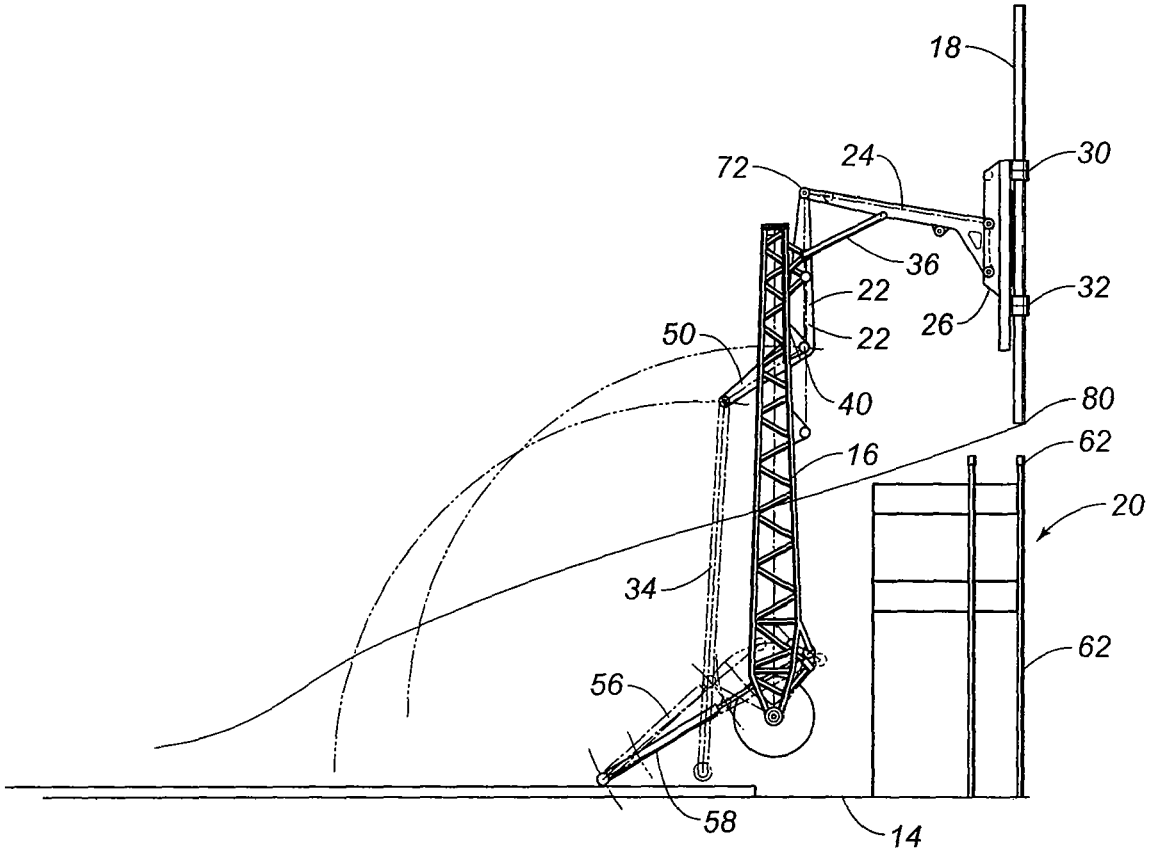
FIG. 5 is a side elevational view showing the pipe handling apparatus in its second position in which the pipe extends in a vertical orientation.

FIG. 5 illustrates the drill pipe 18 in its vertical orientation. As can be seen, the drill pipe 18 is positioned directly above the underlying pipe 62 on the drilling rig 20. The further upward pivotal movement of the supporting structure 16 is caused by the hydraulic cylinders 56 and 58. This causes the link 34 to rotate and draw the end of the second portion 50 of the lever assembly 22 downwardly. The lever assembly 22 rotates about the pivot point 40 such that the first portion 48 of the lever assembly 22 has a pivot 72 at its upper end. The brace 36 is now rotated in a position so as to provide support for the arm 24 in this upper position. The gripper assembly 26 has grippers 30 and 32 aligned vertically and in spaced parallel relationship to each other. If any further precise movement is required between the bottom end 80 of the pipe 18 and the upper end 82 of pipe 62, then the vehicle 14 can be moved slightly so as to achieve further precise movement. In the manner described hereinbefore, the drill pipe 18 has achieved a completely vertical orientation by virtue of the interrelationship of the various components of the present invention and without the need for complex control mechanisms and hydraulics.

In order to install the drill pipe 18 upon the pipe 62, it is only necessary to vertically translate the grippers 30 and 32 within the body 28 of the gripper assembly 26. As such, the end 80 can be stabbed into the box connection 82 of pipe 62. Suitable tongs, spinners, or other mechanisms can be utilized so as to rotate the pipe 18 in order to achieve a desired connection. The grippers 30 and 32 can then be released from the exterior of the pipe 18 and returned back to the original position such that another length of drill pipe can be installed.

Figure 6:
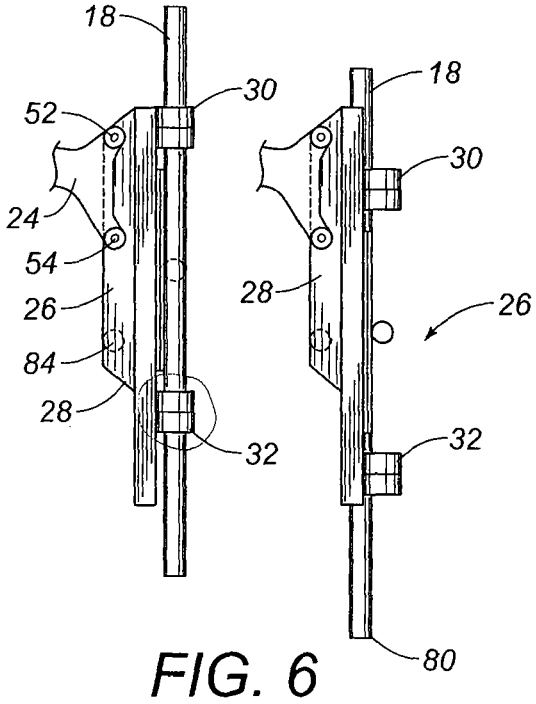
FIG. 6 is an illustration of the gripper assembly as vertically translating the pipe.

FIG. 6 is a detailed view of the gripper assembly 26 of the present invention. In FIG. 6, the pin connections 52 and 54 have been installed into alternative holes formed on the body 28 of the gripper assembly 26. The holes, such as hole 84, can be formed in a surface of the body 28 so as to allow selective connection between the end of the arm 24 and the body 28 of gripper assembly 26. As such, the position of the gripper assembly 26 in relation to the arm 24 can be adapted to various circumstances.

It can be seen that the pipe 18 is engaged by grippers 30 and 32 of the gripper assembly 26. The configuration of the grippers 30 and 32, as shown in FIG. 6, is particularly designed for a short length (approximately 30 feet) of drill pipe. In FIG. 6, it can be seen that the grippers 30 and 32 are translated relative to the body 28 so as to lower end 80 of pipe 18 downwardly for connection to an underlying pipe.

Figure 7:
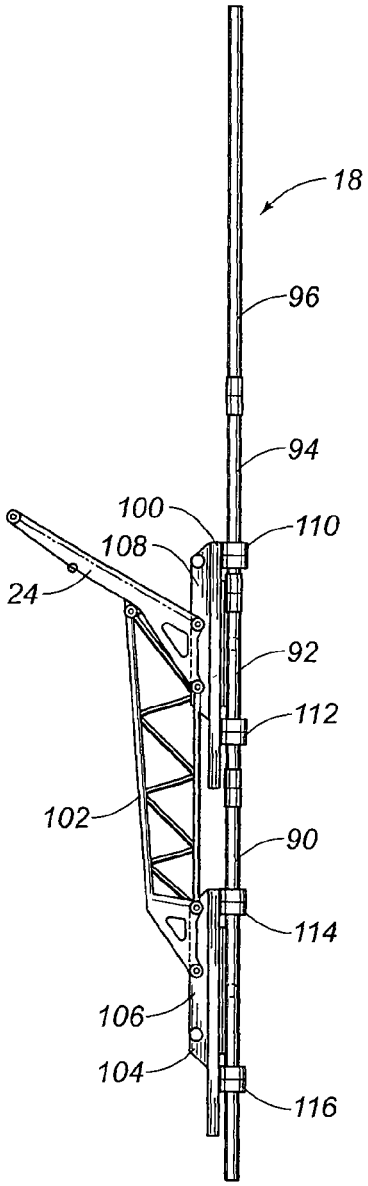
FIG. 7 is a side elevational view of a first alternative embodiment of the gripper assembly of the present invention.

Occasionally, it is necessary to accommodate longer lengths of pipe. In other circumstances, it is desirable to accommodate pipes that are already assembled in an extended length. In FIG. 7, it can be seen that the drill pipe 18 is formed of separate sections 90, 92, 94 and 96 that are joined in end-to-end connection so as to form an extended length of the pipe 18. When such pipe arrangements are required, the gripper assembly 26 of the present invention will have to be adapted so as to accommodate such extended lengths. Fortunately, the structure of the apparatus 10 of the present invention can accommodate such an arrangement. As can be seen in FIG. 7, the arm 24 is connected to a first gripper assembly 100 and connected by stab frame 102 to a second gripper assembly 104. The second gripper assembly 104 is located directly below and vertically aligned with the first gripper assembly 100. The stab frame 102 includes a suitable pin connection for engaging the body 106 of the second gripper assembly 104. The first gripper assembly 100 has body 108 that is directly connected to the pin connections associated with the arm 24. The gripping assembly 100 includes grippers 110 and 112 which engage in intermediate position along the length of pipe 18. The grippers 114 and 116 of the second gripper assembly 104 engage the lower portion of the pipe 18. The method of moving the pipe 18 from the horizontal position to the vertical position is similar to that described hereinbefore.

It should be noted that the arm 24 can extend at various angles with respect to the gripper assemblies 100 and 104. In the preferred embodiment, the arm 24 will be generally transverse to the length of the body associated with the gripper assemblies 100 and 104. However, if needed to accommodate certain drilling rig height and arrangements, the arm 24 can be angled up to 30° from transverse with respect to the body associated with the gripper assemblies 100 and 104.

Figure 8:
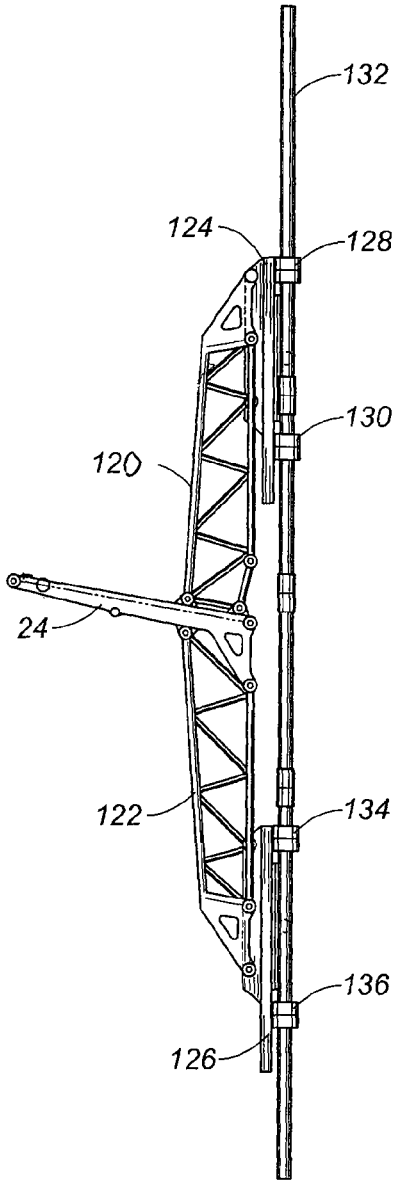
FIG. 8 is a side elevational view showing a second alternative embodiment of the gripper assembly of the present invention.

In FIG. 8, it an be seen that the arm 24 has a first stab frame 120 extending upwardly from the top of the arm 24 and a second stab frame 122 extending below the arm 24. The first stab frame 120 includes a gripper assembly 124 affixed thereto. The second stab frame 122 includes a gripper assembly 126 connected thereto. The arm 24 will include suitable pin connections located on the top surface thereof and on the bottom surface thereof so as to engage with the stab frames 120 and 122. The gripper assembly 124 has suitable grippers 128 and 130 for engaging an upper portion of the pipe 132. The gripper assembly 126 includes grippers 134 and 136 for engaging with a lower portion of the pipe 132. As illustrated in FIG. 8, the pipe 132 is a multiple section pipe. However, pipe 132 can be an extended length of a single pipe section.

Figure 9:
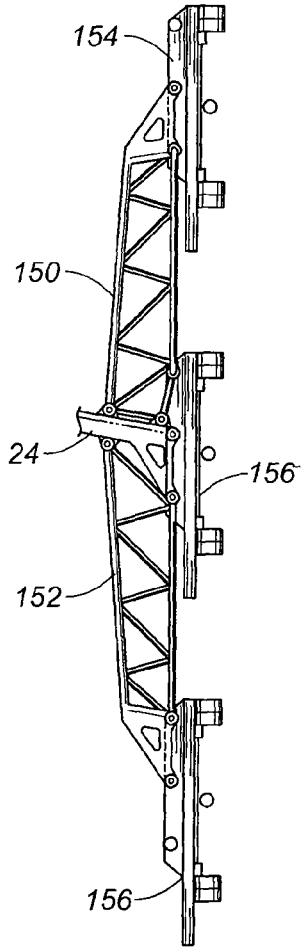
FIG. 9 is a side elevational view showing a third alternative embodiment of the gripper assembly of the present invention.

FIG. 9 shows still another embodiment of the gripper assembly structure of the present invention. In FIG. 9, the arm 24 is connected to the upper stab frame 150 and to the lower stab frame 152. Gripping assemblies 154, 156 and 158 are provided. The gripper assembly 154 is connected to an upper end of the upper stab frame 150. The gripper assembly 158 is connected to a lower end of the lower stab frame 152. The gripper assembly 156 is intermediately located directly on the opposite side of the end of the arm 24 and connected to the lower end of the upper stab frame 150 and to the upper end of the lower stab frame 152. As such, the present invention provides up to three gripper assemblies 154, 156, and 158 to be connected. This can be utilized so as to accommodate even longer lengths of pipe, if needed.

The present invention achieves a number of advantages over the prior art. Most importantly, the present invention provides a pipe handling apparatus and method that minimizes the number of control mechanisms, sensors and hydraulic systems associated with the pipe handling system. Since the movement of the pipe is achieved in a purely mechanical way, only a single hydraulic actuator is necessary for the movement of the supporting structure. All of the other movements are achieved by the interrelationship of the various components. As such, the present invention achieves freedom from the errors and deviations that can occur through the use of multiple hydraulic systems. The simplicity of the present invention facilitates the ability of a relatively unskilled worker to operate the pipe handling system. The amount of calibration is relatively minimal. Since the skid 12 associated with the present invention can be transported by a truck, various fine movements and the location of the pipe handling apparatus 10 can be achieved through the simple movement of the vehicle. The pipe handling apparatus 10 of the present invention is independent of the drilling rig. As such, a single pipe handling apparatus that is built in accordance with the teachings of the present invention can be utilized on a number of rigs and can be utilized at any time when required. There is no need to modify the drilling rig, in any way, to accommodate the pipe handling apparatus of the present invention. Since the pipes are loaded beneath the supporting structure, the providing of the pipe to the pipe handling apparatus can be achieved in a very simple manner. There is no need to lift the pipes to a particular elevation or orientation in order to initiate the pipe handling system.

Figure 10:
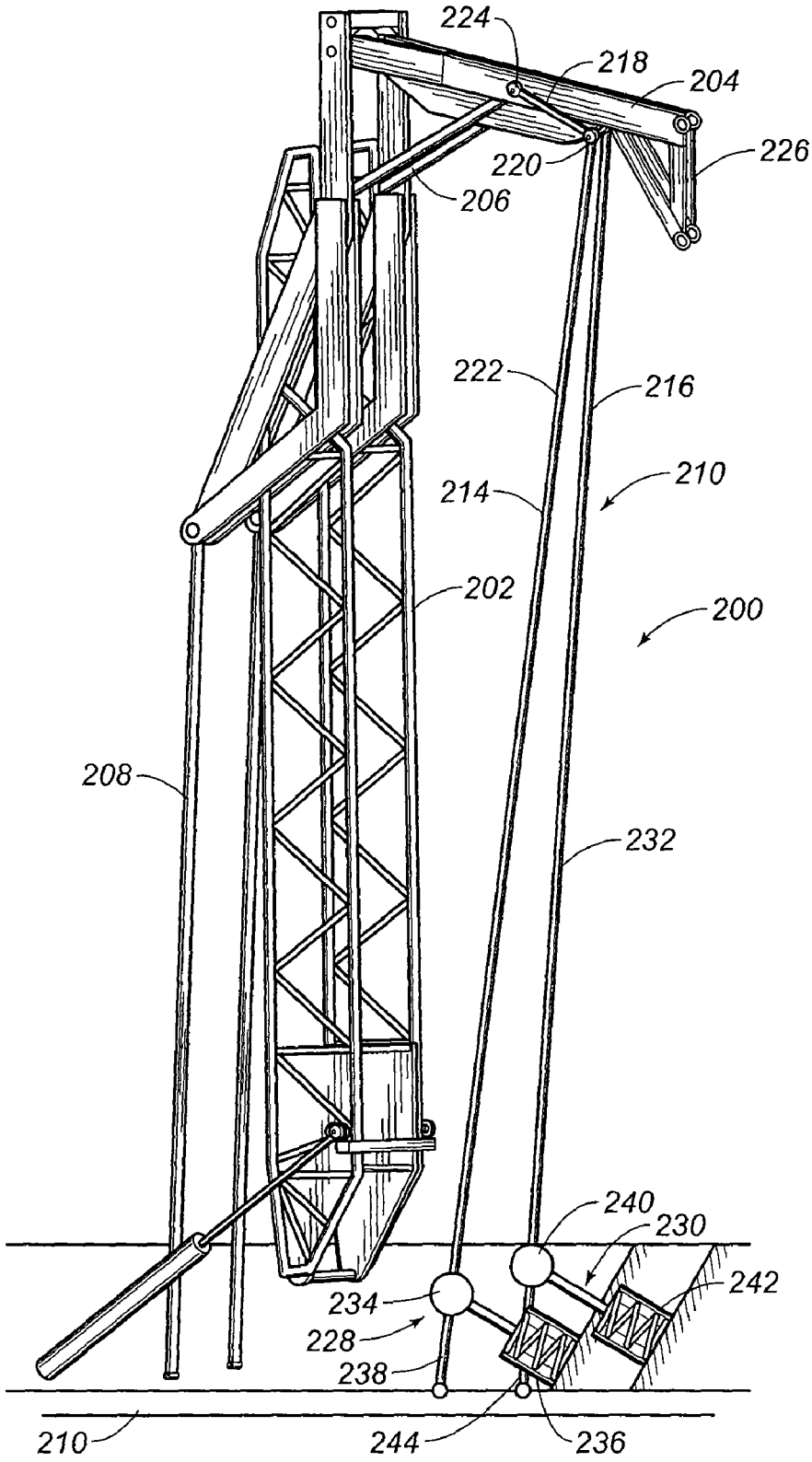
FIG. 10 shows a perspective view in which the stiffener system is applied to the arm of the pipe handling apparatus in accordance with the teachings of the present invention

Referring to FIG. 10 there is shown the pipe handling and casing stabbing apparatus 200 in accordance with the teachings of the present invention. The pipe handling and casing stabbing apparatus 200 has a configuration of supporting structure 202, arm 204, brace 206, link 208 and skid 210 similar to the construction described herein previously. The pipe handling and casing stabbing apparatus 200 includes the addition of a stiffener means 210 applied to the arm 204 and to the skid 210.

The stiffener means 210 includes a first cable assembly 214 and a second cable assembly 216 which are affixed on opposite sides of the arm 204. In particular, the first cable assembly 214 is affixed to a link member 218 that is fixedly pivotally mounted on the arm 204. A stop 220 extends outwardly from the side of the arm 204. The stop 220 serves to stop rotational movement of the link member 218 as the arm 204 moves in a proper direction for the delivery of pipe and/or casing. The cable assembly 214 also includes a cable 222 that has one end affixed to the link member 218 opposite the pivotal connection 224 with arm 204. The cable 222 extends downwardly from the arm 204 so as to be interconnected to the skid 210. In FIG. 10, the cable assemblies 214 and 216 are shown as applying a mechanical resistance to the arm 204. This mechanical resistance serves to offset the load of the pipe as received by the grippers which are affixed to the end 226 of arm 204 (not shown). The second cable assembly 216 has a configuration identical to that of first cable assembly 214.

A first spring pod 228 is connected to the end of the cable 222 opposite the arm 204. A second spring pod 230 is affixed to the cable 232 associated with the second cable assembly 216. The spring pods 228 and 230 serve to apply an angular deflection to each of the cable assemblies 214 and 216 so as to selectively supply a mechanical resistance to the arm 204. Thus, spring pods 228, 230 provide a resilient or elastic element to each stiffening member 214, 216 or cable assembly, such that the force exerted by each stiffening member on arm 214 is greatest at its maximum travel.

As can be seen, a connector element 234 is connected to the end of cable 222. Connector element 234 is also connected to a resilient means 236. An elongate member 238 joins the connector element 234 to the skid 210. Similarly, the cable 232 has an end opposite the arm 204 connected to the connector element 240. Another resilient means 242 is joined to the connector element 240 so as to cause a deflection in the cable assembly 216. The resilient means 242 is fixed positioned on the skid 210. Another elongate member 244 joins the connector element 240 to the skid 210.

In normal use, the resilient means 236 and 242 serves to exert a resilient force which urges each of the cable assemblies 214 and 216 slightly out of linear alignment between the respective cable 222 and 232 with the elongate members 238 and 240. By pulling the connector elements 234 and 240, respectively, toward the resilient means 236 and 242, a greater degree of mechanical resistance can be applied to the cable assemblies 214 and 216 and, in turn, to the arm 204.

In the present invention, the degree of mechanical resistance is greatest at the end of the travel of the arm 204. In other words, when the arm 204 extends into a proper position in which the pipe is in vertical alignment with the wellhead, the mechanical resistance is the greatest. As such, the arm of the present invention receives the greatest stiffness at the point where the pipe will be released.

The system of the is particularly applicable to single and multiple degree of freedom systems. The pre-loading is not repeatable without a single degree of system. In multiple degree of freedom systems, one would have to pre-load all of the degrees of freedom. In a multiple degree of freedom systems, in one failure can cause catastrophic problems for the rest of the system. In the present invention, the stiffness is variable as the system operates. The maximum degree of stiffness occurs when the arm is in its second position at the end of travel. This stiffness can be achieved either through tension loading, such as through the use of the cable assemblies 214 and 216 described herein or by compression loading. Such compression loading could occur by the use of header installed within a V-door of a rig assembly. In other words resistance would applied to the top of the arm rather than from the bottom of the arm. The present invention is also usable in association with the installation of horizontal pipe. The single degree of freedom system can be utilized so as to lay pipelines. Once again, the mechanical resistance can be applied to the mechanical system at the end of the travel of such a system for installing pipe horizontally.

As used herein, each of the resilient means 236 and 242 can be in the form of spring assemblies, as illustrated in FIG. 10, or can be in the nature of a pneumatic cylinder.

Figure 11:
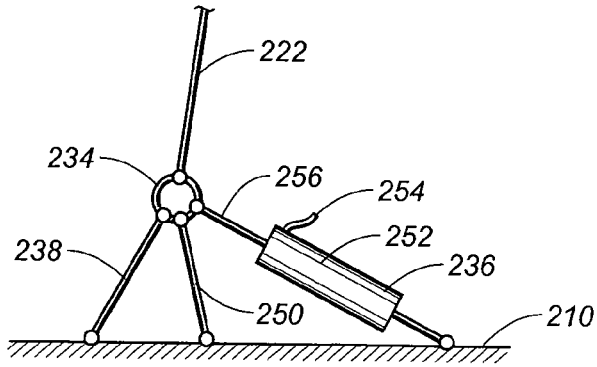
FIG. 11 is a diagrammatic illustration of the resilient means utilized to deflect the cables associated with the stiffener system of the present invention.

In particular, in FIG. 11, it can be seen how the cable 222 is connected to the connector element 234 and to a pair of elongate members 238 and 250. The first elongate member 238 extends at an acute angle with respect to the second elongate member 250. The resilient means 236 is in the form of a pneumatic cylinder 252. A source of pneumatic pressure 254 communicates with the interior of the pneumatic cylinder 252 so as to allow for the adjustment of the degree of movement of the piston 256. As the piston 256 is drawn into the pneumatic cylinder 252, the piston 256 will draw the connector element 234 toward the pneumatic cylinder 252 and increase the amount of deflection between the elongate members 238 and 250 relative to the cable 222. The pneumatic cylinder 252 is affixed to the skid 210 at an end opposite the connector element 234.

The pre-loading system 200, as shown in FIGS. 10 and 11 greatly enhances the ability to avoid springback and to establish greater precision in the delivery of pipe and/or casing to the drilling rig. It has been found, that in experimental tests, that 0.03 inches of total lateral motion applied to the cable assemblies 214 and 216 allows for the removal or addition of 10,000 pounds (the maximum payload) of load applied to the arm 204. The ability to avoid the springback and to achieve this maximum accuracy allows the present invention to stab casing within a 1/16 of an inch tolerance. This deflection of the cable assemblies 214 and 216 increases the stiffness of the pipe handling apparatus of the present invention by a factor of 300. The load is shifted directly from the arm 204 toward the stop and the anchoring on the skid 210 instead of directly on the arm.

Figure 12:
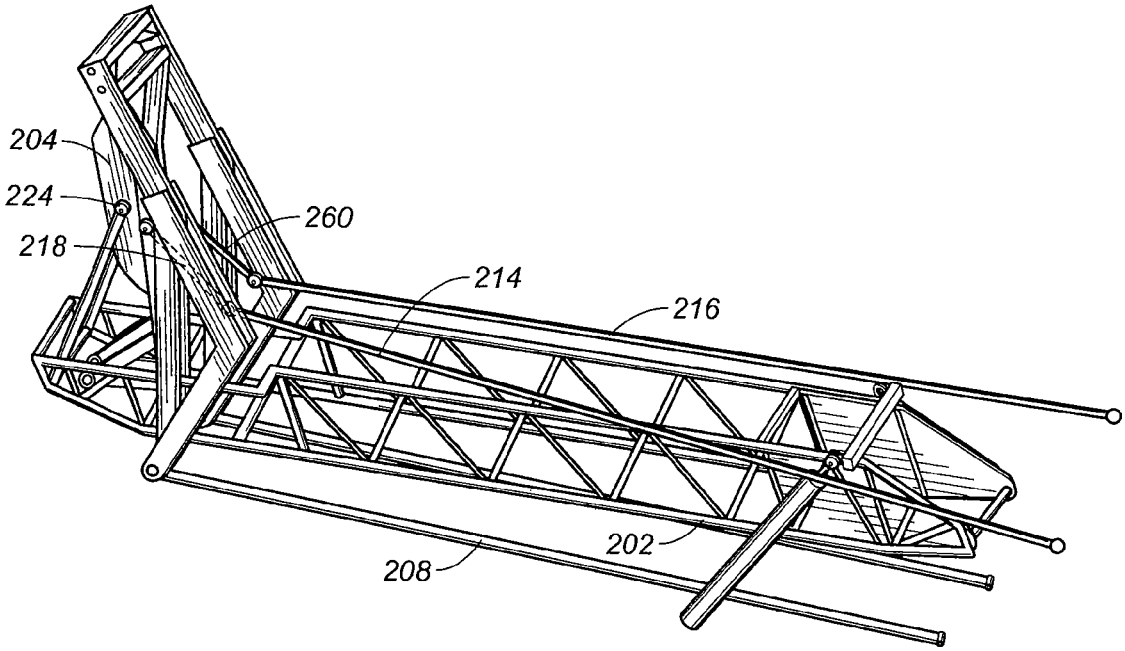
FIG. 12 is a perspective view showing the orientation of the stiffener system of the present invention when the supporting structure is in a generally horizontal orientation.

FIG. 12 shows the supporting structure 202 in its generally horizontal orientation upon the skid 210. In this position, the gripper assemblies associated with the arm 204 are in position to receive a pipe or casing therein. It can be seen that the link members 218 and 260 are in a position away from the respective stops. The link members 218 and 260 will rotate about the pivot point 224 during the movement of the arm 204 and during the movement of the supporting structure 202. The respective cable assemblies 214 and 216 will generally drape along the outside of the supporting structure 202.

Figure 13:
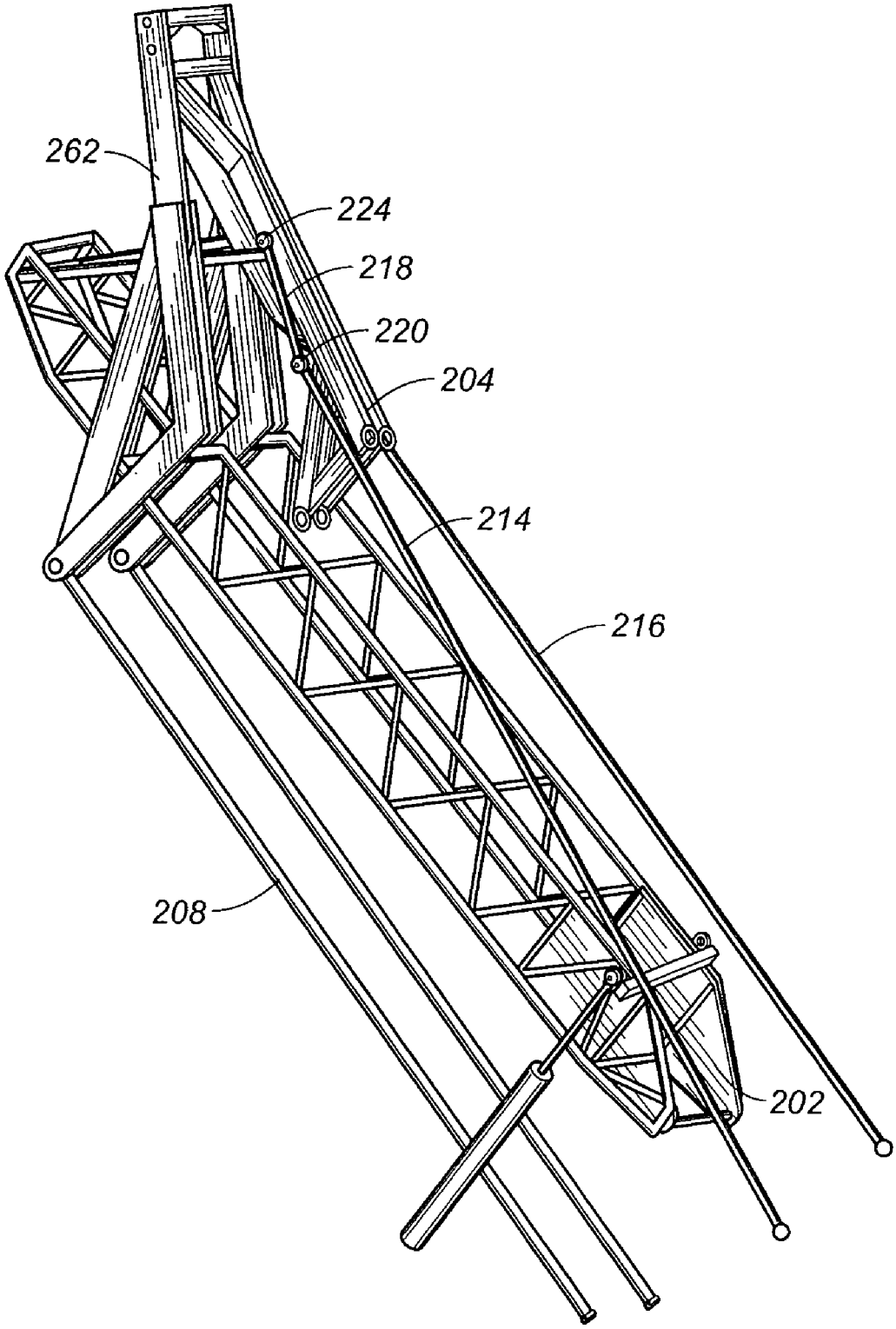
FIG. 13 is a perspective view of the stiffener system of the present invention as the supporting structure moves from the horizontal orientation toward the vertical orientation.
Figure 1:
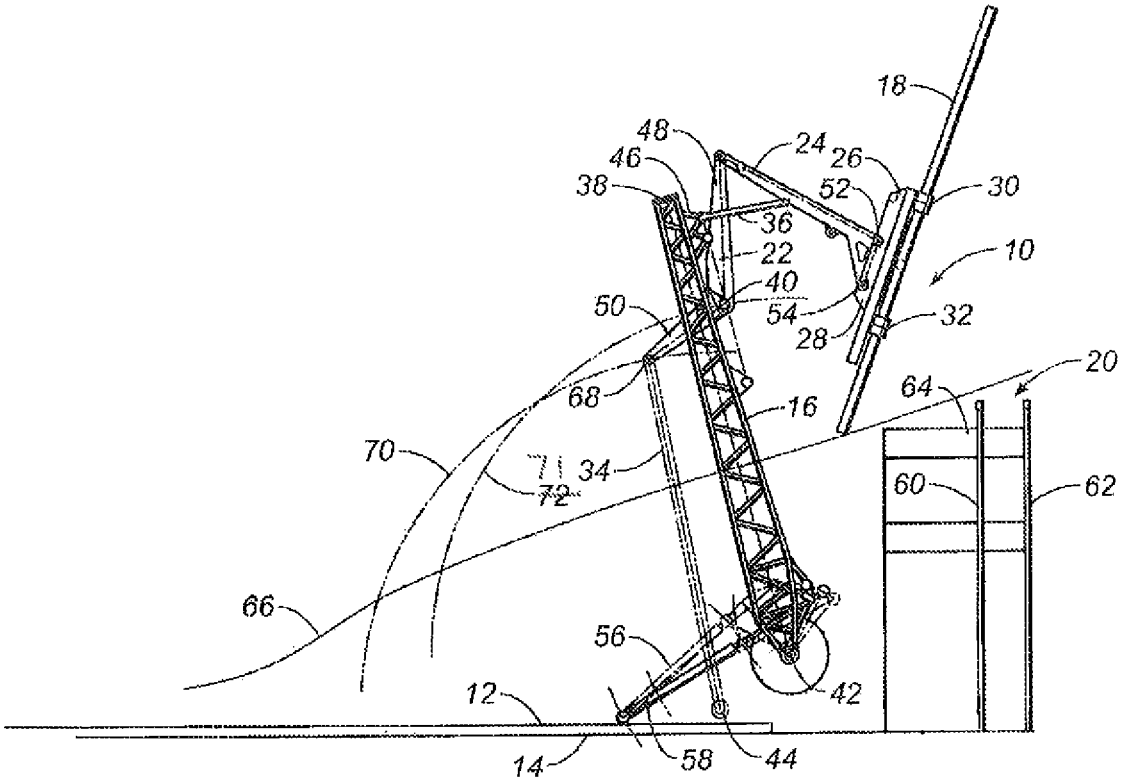
Figure 2:
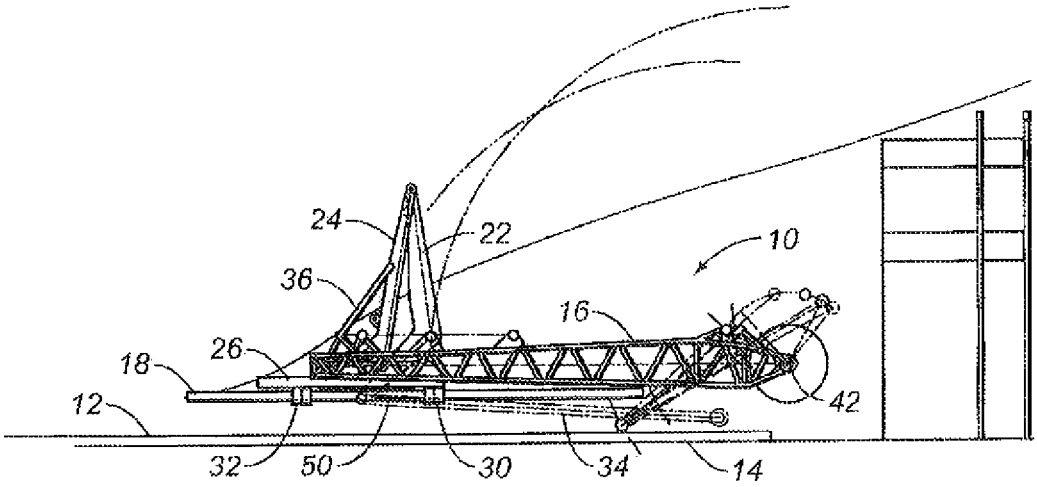
Figure 3:
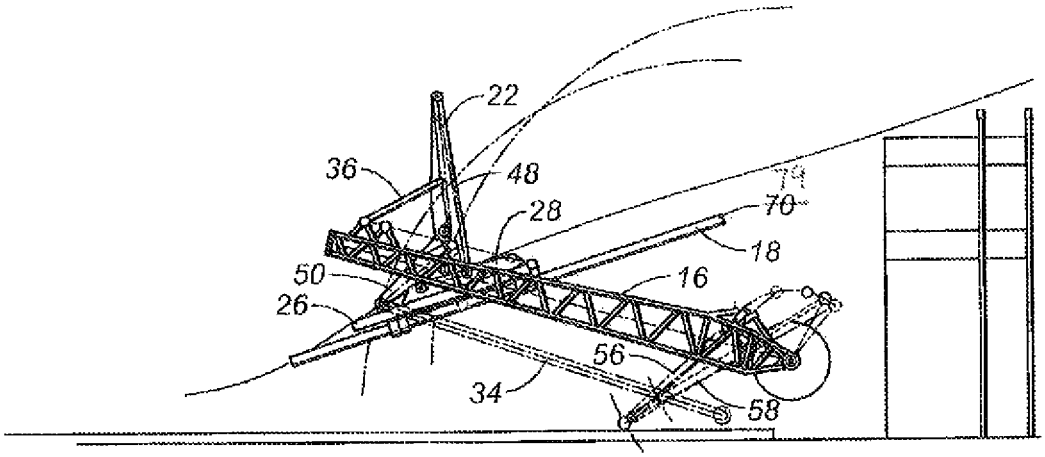
Figure 4:
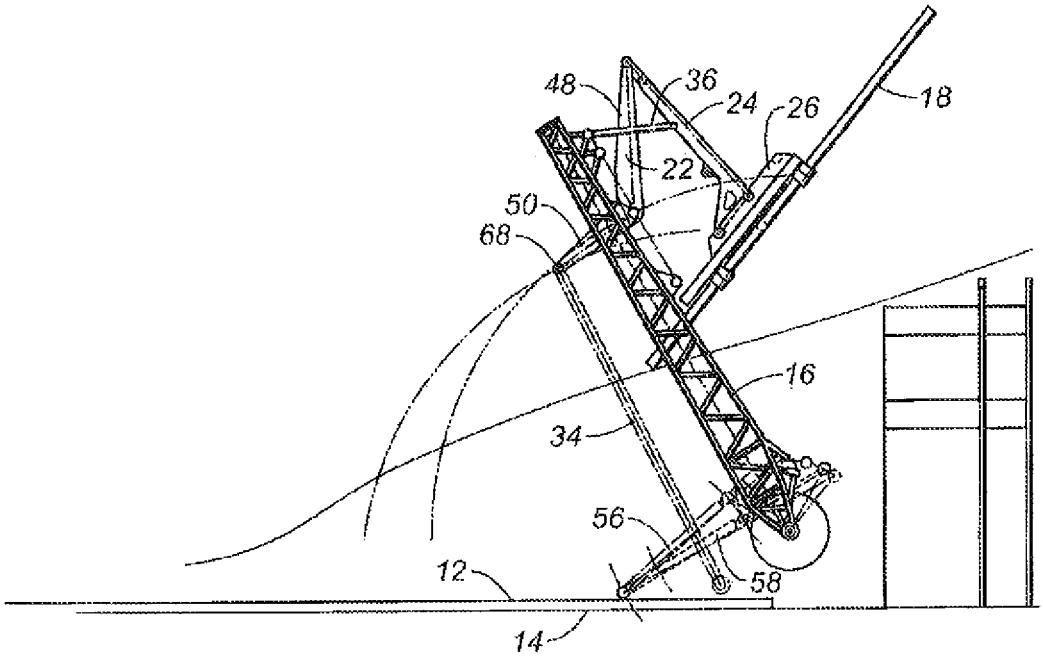
Figure 5:
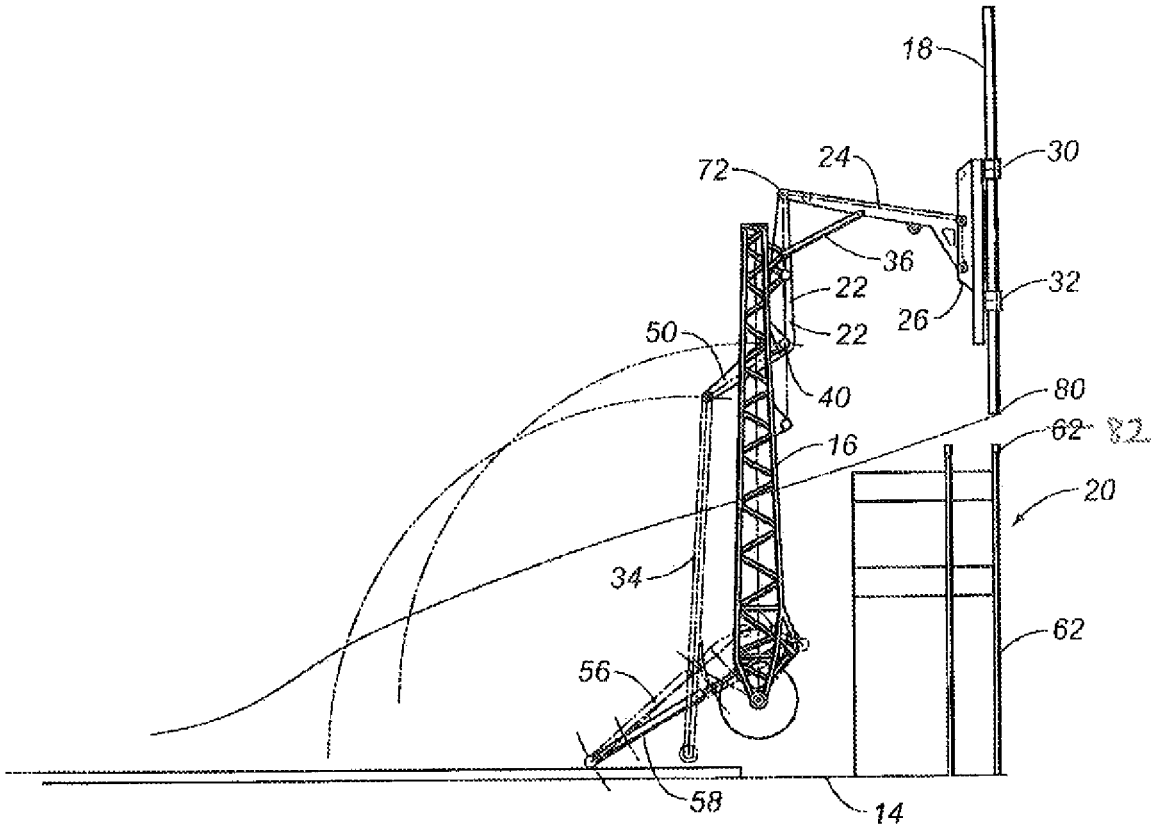
Figure 6:
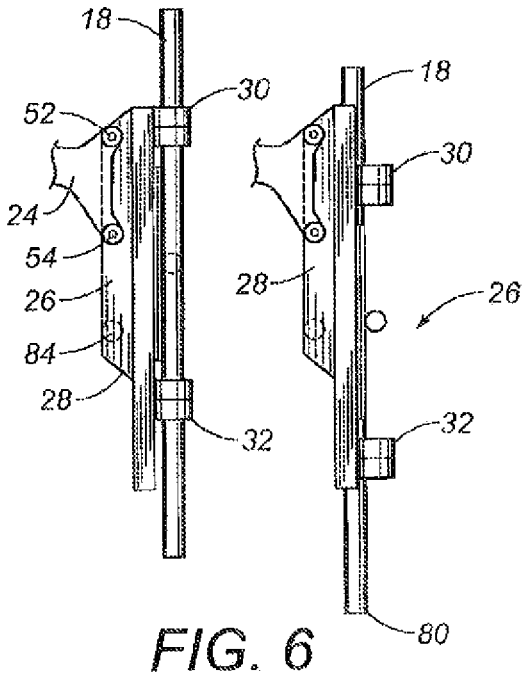

FIG. 13 shows the movement of the supporting structure 202 from the position adjacent to the skid to the vertical position. As can be seen, the arm 204 is pivoting with respect to lever assembly 262. The link member 218 is pivotable and rotatable about the pivot point 224 during this movement. It can be seen that the arm 204 will move upwardly between the respective cable assemblies 214 and 216. Eventually, the arm 204 will assume a generally horizontal orientation when it is necessary to position the pipe and/or casing into a desired position. This causes the link member 218 to contact the stop 220. As a result, the tensioning of the arm 204 can begin.

Importantly, the enhanced accuracy and the ability to avoid deflection of the arm 204 during the installation and release of the pipe and/or casing enhances the ability to present invention to deliver casing to the drilling rig. Since the casing must be delivered with extreme accuracy, the avoidance of deflection, as caused by the present invention, will allow the maximum amount of deflection to be merely 0.07 inches. When the weight of the pipe and/or casing is released, any deflection is absorbed by the stop 220 and by an anchor, such as the skid 210. The arm 204 will be maintained in a generally fixed position at this time, rather than springing back.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A pipe handling apparatus for moving a pipe to a drill floor comprising:

a supporting structure;

an arm extending from said supporting structure, said arm movable between a first position away from the drill floor and a second position over the drill floor; and a stiffening member coupled at one end of said arm and at another end to a surface structure, the stiffening member including an elastic element configured to apply a variable resistance to said arm as said arm moves from said first position to said second position, the variable resistance being greatest when said arm is in said second position, said stiffening member further comprising:

a first cable assembly having one end connected to said arm and an opposite end fixedly mounted to the surface structure, said first cable assembly extending downwardly from one side of the arm, said first cable assembly further comprising a link member pivotally mounted to said arm, a cable affixed to said link member at one end thereof, a spring pod affixed to an opposite end of said cable, and a member having one end connected to said spring pod and an opposite end fixedly mounted; and a second cable assembly having one end interconnected to the arm and an opposite end fixedly mounted to the surface structure, said second cable assembly extending downwardly from an opposite side of the arm, said second cable assembly further comprising a link member pivotally mounted to said arm, a cable affixed to said link member at one end thereof, a spring pod affixed to an opposite end of said cable, and a member having one end connected to said spring pod and an opposite end fixedly mounted.

2. The pipe handling apparatus of claim 1, said second position being an end of travel of said supporting structure and said arm.

3. The pipe handling apparatus of claim 1, said arm moving between said first and second positions within a single degree of freedom, said supporting structure being a boom pivotally mounted to an underlying surface.

4. The pipe handling apparatus of claim 1, further comprising:

a gripper configured to receive and support the pipe in a vertical orientation when said supporting structure and said arm are in said second position.

5. The pipe handling apparatus of claim 4, said gripper configured to grasp a horizontally oriented pipe when said arm and said supporting structure are in said first position.

6. The pipe handling apparatus of claim 4, said supporting structure having an open interior area.

7. The pipe handling apparatus of claim 1, said spring pod comprising:

a connector element affixed to said opposite end of said cable and to said one end of said member; and a coil spring configured to urge said connector clement in a direction away from alignment of said member with said cable.

8. The apparatus of claim 1, wherein the surface structure comprises a skid on which the supporting structure is mounted.

9. A pipe handling apparatus for moving a pipe to a drill floor comprising:

a supporting structure;

an arm extending from said supporting structure, said arm being movable between a first position away from the drill floor and a second position over the drill floor;

a first stiffening member having one end connected to said arm and an opposite end mounted therebelow, said first stiffening member extending downwardly from one side of said arm and including an elastic spring element such that said first stiffening member applies a variable resistance to said arm as said arm moves from said first position to said second position, said variable resistance being greatest when said arm is in said second position, said first stiffening member further including a link member pivotally mounted to the arm, a cable affixed to said link member at one end thereat, a spring pod affixed to an opposite end of said cable; and a member having one end connected to said spring pod and an opposite end fixedly mounted; and a second stiffening member having one end interconnected to said arm and an opposite end fixedly mounted therebelow, said second stiffening member extending downwardly from an opposite side of said arm and including an elastic spring element such that said second stiffening member applies a variable resistance to said arm as said arm moves from said first position to said second position, said second stiffening member further including a link member pivotally mounted to the arm, a cable affixed to said link member at one end thereat, a spring pod affixed to an opposite end of said cable; and a member having one end connected to said spring pod and an opposite end fixedly mounted.

10. The pipe handling apparatus of claim 9, said supporting structure and said arm moving between said first position to said second position within a single degree of freedom, said supporting structure being a boom pivotally mounted to an underlying surface.

11. The pipe handling apparatus of claim 10, said boom having an open interior area, said arm moving through said open interior as said boom and said arm move from said first position to said second position.

12. The pipe handling apparatus of claim 9, said second position being an end of travel of said supporting structure and said arm.

13. The pipe handling apparatus of claim 9, said first stiffening member connected to an end of said arm opposite said supporting structure.

14. The pipe handling apparatus of claim 9, further comprising:

a gripper affixed to an end of said arm opposite said supporting structure, said gripper suitable for receiving and supporting the pipe in a vertical orientation when said supporting structure and said arm are in said second position.

15. The pipe handling apparatus of claim 14, said gripper suitable for grasping a horizontally oriented pipe when said arm and said supporting structure are in said first position.

16. The pipe handling apparatus of claim 9, said spring pod comprising:

a connector element affixed to said opposite end of said cable and to said one end of said member; and a coil spring configured to urge said connector element in a direction away from alignment of said member with said cable.

17. The apparatus of claim 9, wherein the surface structure comprises a skid on which the supporting structure is mounted.

18. An apparatus for handling tubular members adjacent a drilling platform, the apparatus comprising:

a boom pivotally mounted at its lower end to a surface structure and having an open structure, the boom movable in a single degree of freedom between a generally horizontal position and a generally vertical position adjacent and over the drilling platform;

an arm pivotally mounted to an upper end of the boom, the arm movable to a maximum travel when the boom is in the generally vertical position;

a gripper carried by the arm and configured to grasp and carry tubular members, wherein the gripper and arm pivot through the open structure of the boom;

at least one stiffening member coupled to the arm at one end and to the surface structure at another, the stiffening member including an elastic spring member configured to apply a variable resistance to the arm, the variable resistance being greatest at the maximum travel of the arm, the stiffening member further including a pair of cables, a link member connected to one end of each cable, each link member being pivotally connected to the arm, and a coil spring coupled to each cable.

19. The apparatus of claim 18, wherein the surface structure comprises a skid on which the boom is mounted.

* * * * *

UNITED STATES PATENT AND TRADEMARK OFFICE

CERTIFICATE OF CORRECTION

PATENT NO. : 7,980,802 B2
APPLICATION NO. : 12/259245
DATED : July 19, 2011
INVENTOR(S) : Keith J. Orgeron It is certified that error appears in the above-identified patent and that said Letters Patent is hereby corrected as shown below:

Drawings,
Sheet 1, Fig. 1, the reference numeral 72, pointing to one of the curved lines, should read 71 as attached
Sheet 2, Fig. 3, the reference numeral 70, pointing to the end of pipe 18, should read 79 as attached
Sheet 3, Fig. 5, the reference numeral 68, pointing to the upper end of pipe 62, should read 82 as attached Column 10,
Line 67, delete "72" and insert --71--

Column 11,
Line 64, delete "70" and insert --79--

Signed and Sealed this
Fifteenth Day of May, 2012

David J. Kappos

David J. Kappos
*Director of the United States Patent and Trademark Office*